United States Patent [19]

Desarzens et al.

[11] 4,076,102

[45] Feb. 28, 1978

[54] TRAP DOOR AND FOLDING LADDER ARRANGEMENT

[75] Inventors: Francis Desarzens, Prilly; Claude Cruchet, Apples, both of Switzerland

[73] Assignee: Arcia SA, Switzerland

[21] Appl. No.: 760,911

[22] Filed: Jan. 21, 1977

[30] Foreign Application Priority Data

Feb. 3, 1976 Switzerland ..... 1328/76

[51] Int. Cl.[2] ..... E06C 9/14

[52] U.S. Cl. ..... 182/81; 182/157

[58] Field of Search ..... 182/81, 157, 70, 77, 182/78, 158

[56] References Cited

U.S. PATENT DOCUMENTS

| | | | |
|---|---|---|---|
| 876,354 | 1/1908 | Houghton | 182/157 |
| 877,363 | 1/1908 | Nielsen | 182/157 |
| 3,025,925 | 3/1962 | Pook | 182/157 |

*Primary Examiner*—Reinaldo P. Machado

*Attorney, Agent, or Firm*—Bucknam and Archer

[57] ABSTRACT

A trap door and folding ladder arrangement, suitable for use as a fire escape for multi-storey buildings, comprises a folding ladder which can be stored and locked in a folded position in a casing. A cover is connected to the ladder and the casing by two systems of levers and connecting rods arranged to automatically open the cover when the ladder is unlocked and unfolds by its own weight.

3 Claims, 7 Drawing Figures

TRAP DOOR AND FOLDING LADDER ARRANGEMENT

The invention concerns trap doors with folding ladders.

It is known to equip buildings with external fire-escape stairways. Such stairways are not only of a high cost price but are inaesthetic and very bulky.

The invention concerns a trap door and folding ladder arrangement which may advantageously be used as an external fire-escape on a building and which comprises a casing able to receive the ladder folded in a storage position, the ladder comprising two uprights composed of rung-supporting pieces and intermediate pieces pivotally connected to one another to form an extensible folding structure, and a cover connected to the casing and to each upright of the ladder by a system levers and connecting rods whereby the ladder when unfolding automatically actuates raising of the cover then moving it forward by a slight distance to free a rear edge of the cover from a corresponding side of the casing, and finally complete opening of the cover when the ladder is complete unfolded.

The accompanying drawings show, by way of example, an embodiment of a trap door with folding ladder according to the invention. In the drawings.

Figure 4:
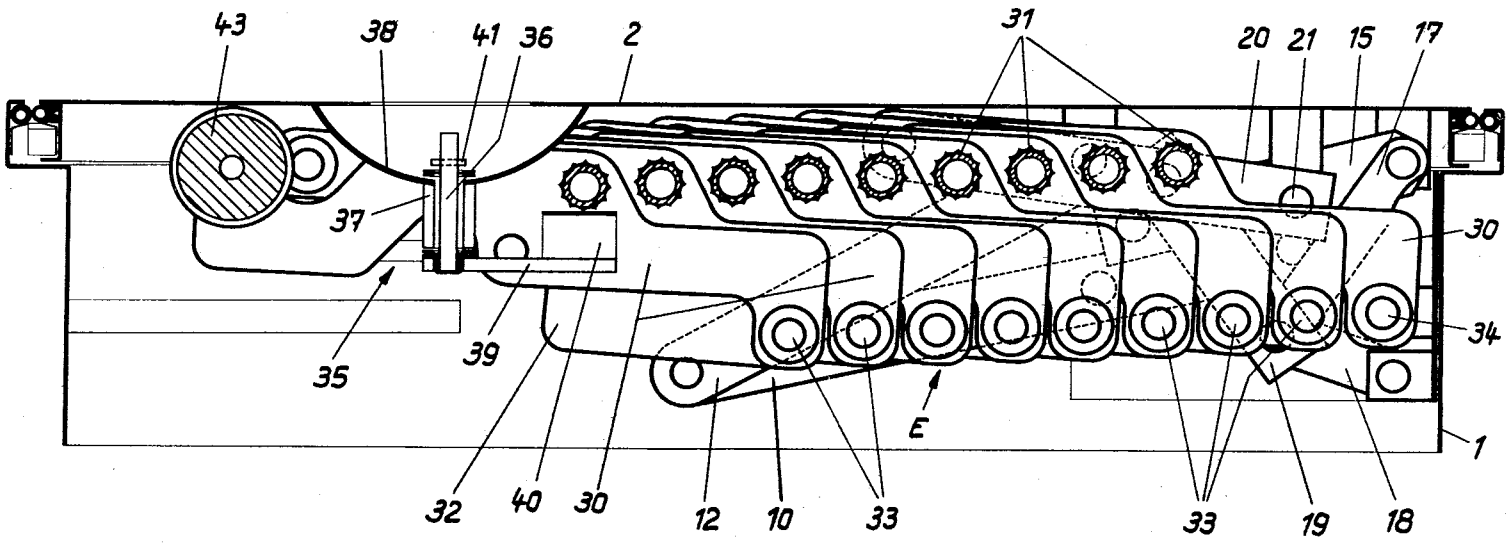
FIG. 4 is a side elevational view of the ladder in the folded storage position with the trap door closed.

The illustrated trap door with a folding ladder E includes a casing 1 which receives the ladder E (FIGS. 4–6) folded in a storage position as shown in FIG. 4. This ladder E comprises two uprights, only one of which is shown in the drawings, each upright being composed of pieces 30 carrying rungs 31 and intermediate pieces 32 pivoted to one another at 33 to form an extensible folding structure of "Nuremberg scissors". A ladder of this type is described and shown in Swiss Patent Specification No. 554 998.

An upper cover 2 is connected to the casing 1 and to the two uprights of the ladder E by two systems of levers and connecting rods described in detail further on.

A locking device designated generally by 35 enables the ladder E to be locked in the folded storage position inside the casing 1. This locking device comprises a vertical rod 36 mounted in a support sleeve 37 fixed to the bottom of a part-spherical recess 38 in the cover 2. The rod 36 carries on its lower end an arm 39 having a projection 40 on which the lower rung 31 comes to rest in the locked position (FIG. 4). The upper end of the rod 36 projects in the recess 38 and has a square for engagement of a manoeuvring tool, not shown, a pin 41 serving to maintain the rod 36. About the recess 38, the cover 2 has a projecting edge 42 forming a gripping means to enable opening the cover 2 by hand, if need be.

The systems of levers and rods connecting the upper intermediate pieces of the uprights of the ladder to the cover each comprise the following elements:

A first lever 10 pivoted on the casing 1 about a fixed axis 11 is pivotally connected at one of its ends to an end of a second lever 12 whose other end is pivoted to the cover 2 about a fixed point 13. The other end of the first lever 10 is pivotally connected to one end of a first connecting rod 14 whose other end is pivotally connected to an end of a third lever 15 pivoting about an axis 25 fixed on the casing 1. The other end of lever 15 is pivotally connected to the cover 2 about an axis 16. The pivoting axis 16 of cover 2 also pivotally receives an end of a fourth lever 17 whose other end is pivotally connected to a fifth lever 18 (pivotally connected at 46 to the casing 1) and to a second connecting rod 19 connected at 45 to a sixth and last lever 20. One end 21 of this lever 20 is connected to the cover 2 and its other end 22 to the first intermediate piece 32 of the corresponding upright of the ladder.

The ladder E shown in the folded position in FIG. 4 is unlocked by turning the rod 36 of the locking device by engaging a tool, not shown, with the square on the upper end of rod 36.

Figure 5:
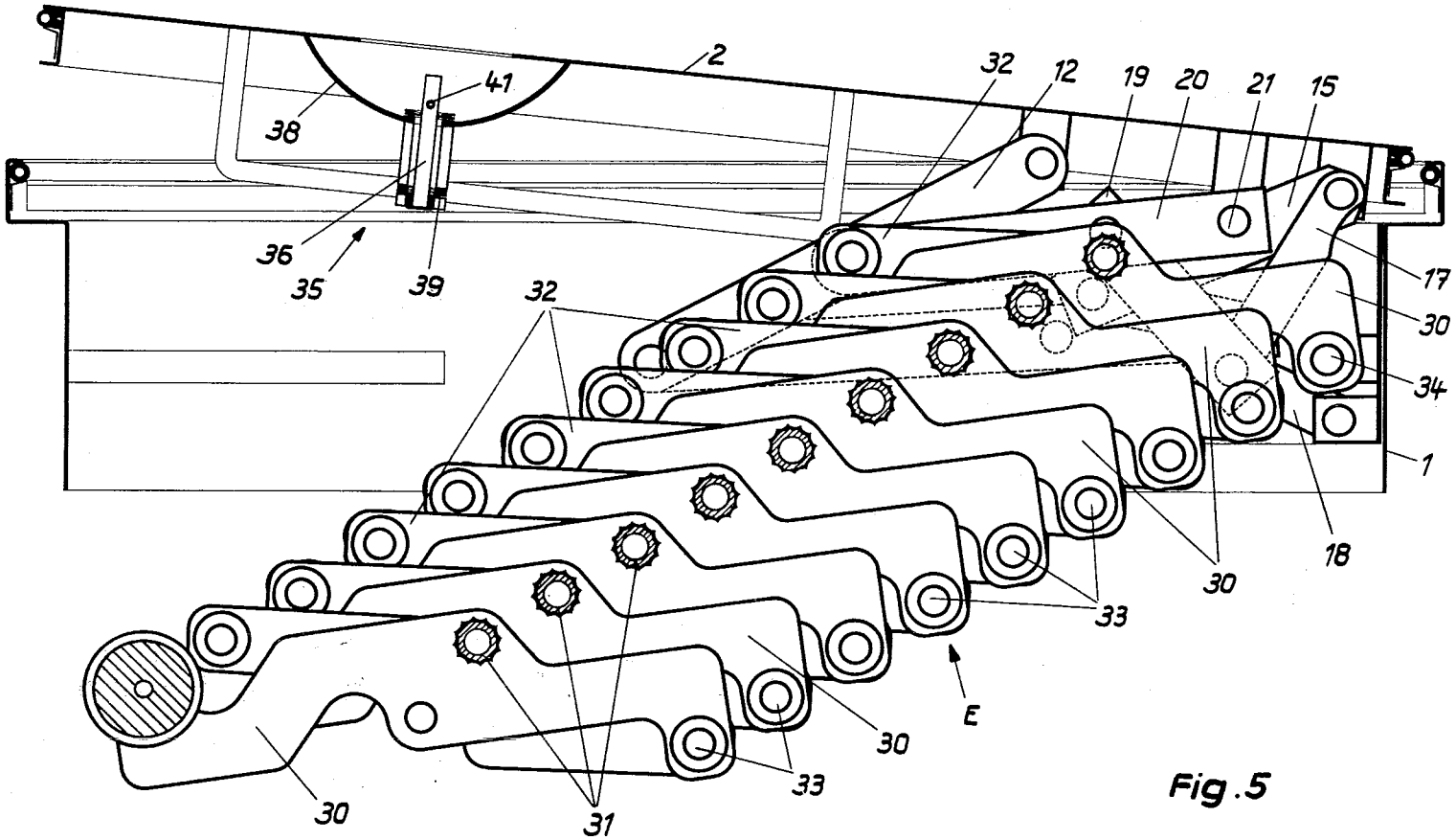
FIGS. 5 and 6 are views similar to FIG. 4 with the ladder partly and fully unfolded and the trap door respectively at the beginning of opening and fully open.
Figures 6, 7:
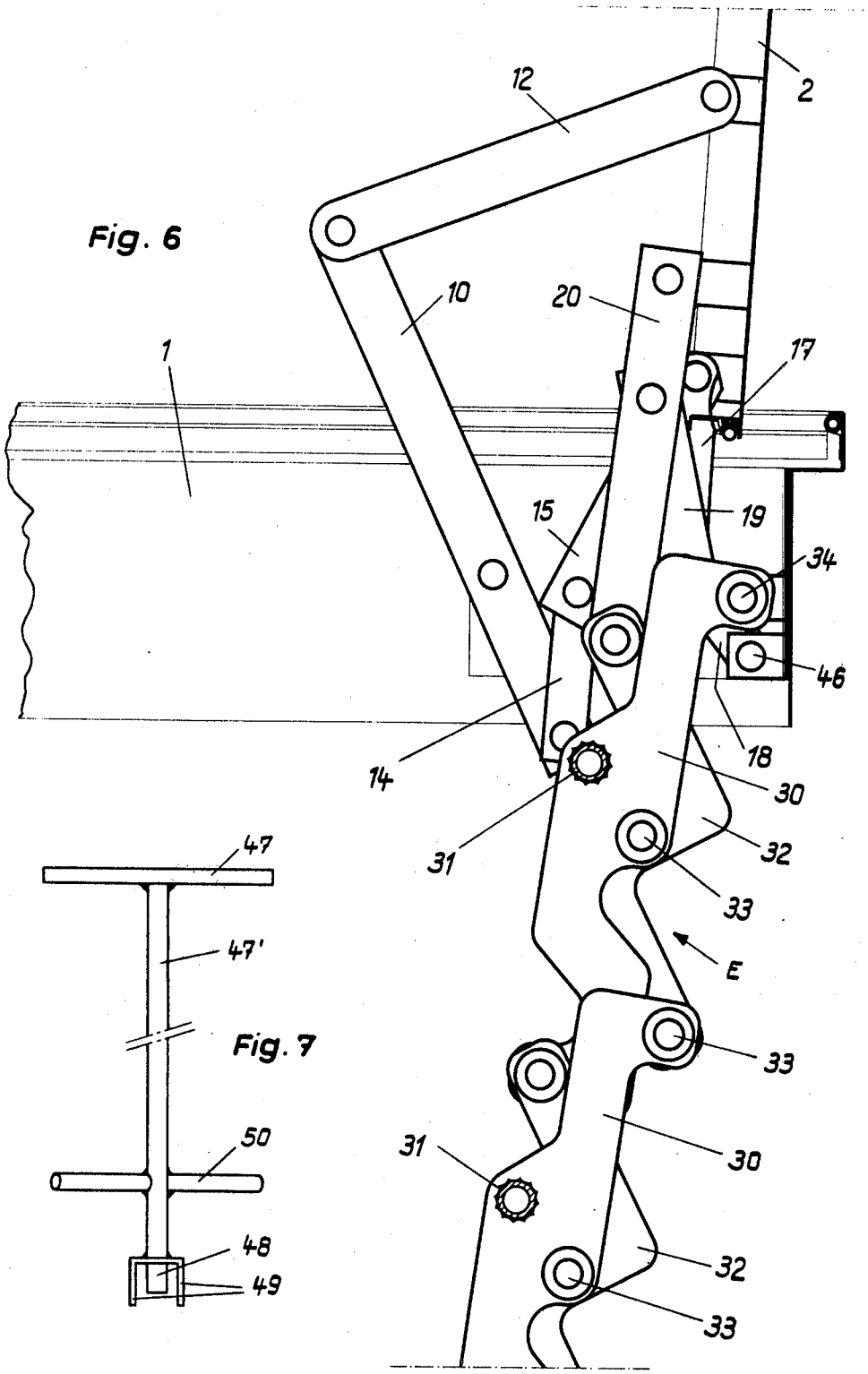
FIG. 7 is a schematic view of a manoeuvring tool.

The arm 39 with the projection 40 is thus disengaged from the lower rung 31 of the ladder which by its own weight, including a balancing weight 43, unfolds and passes through the intermediate position of FIG. 5 to become completely unfolded as shown in FIG. 6. Simultaneously, the cover 2 of the trap door is automatically opened.

Figure 1:
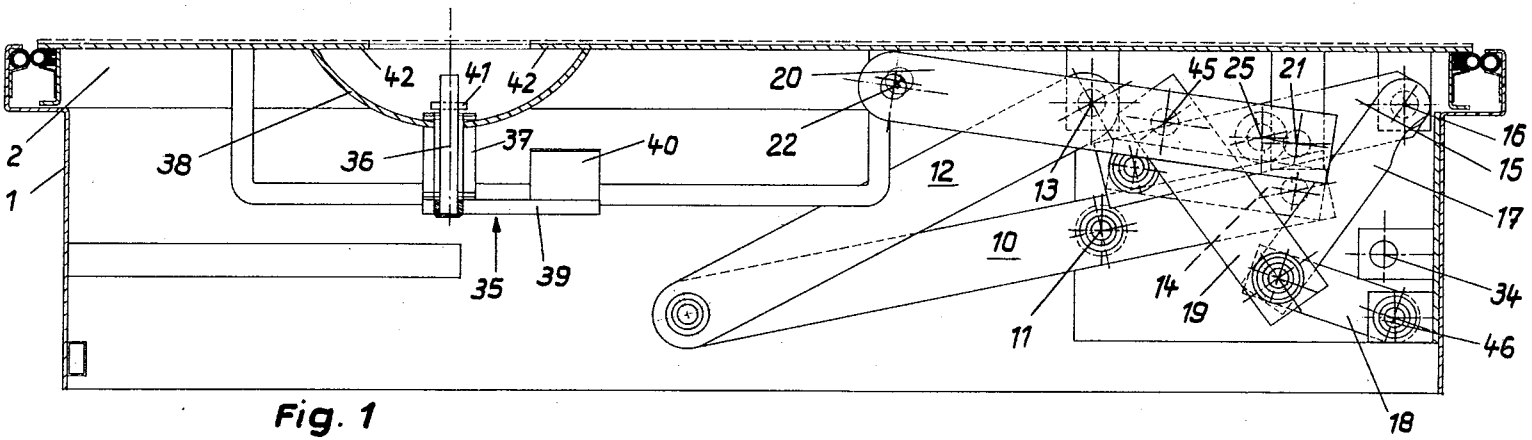
FIG. 1 is a cross-section of the trap door without the ladder.
Figure 2:
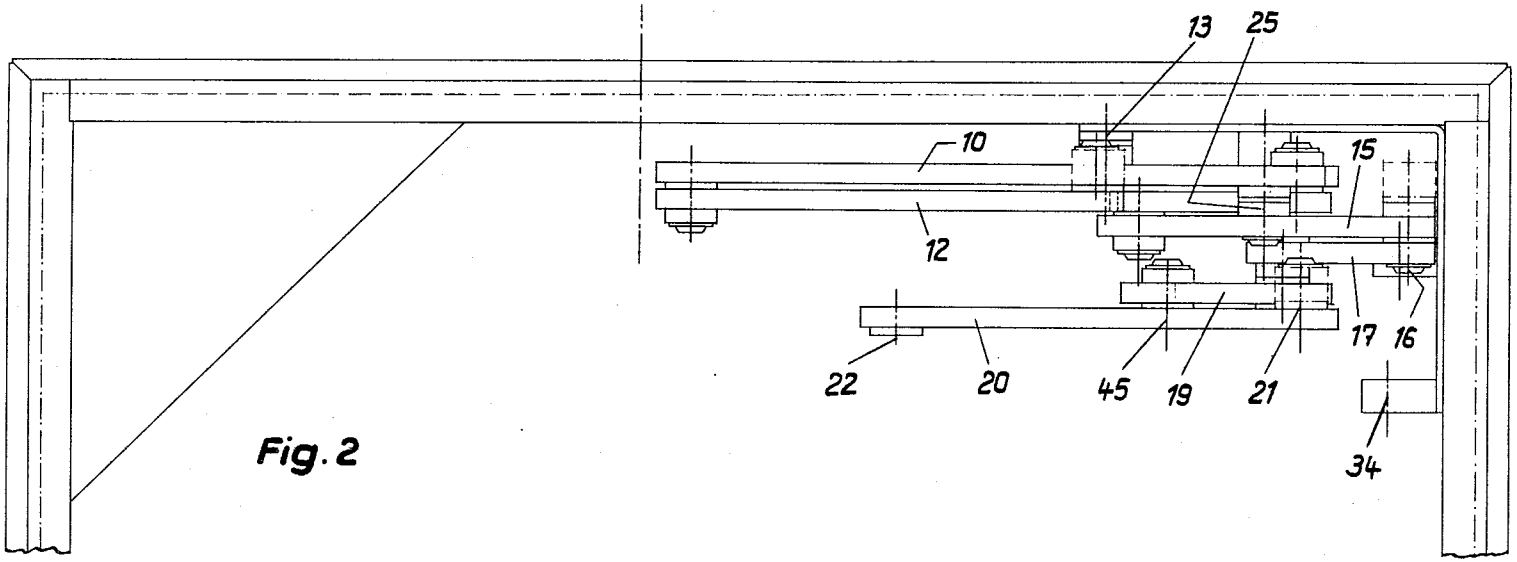
FIG. 2 is a prtly broken away plan view of FIG. 1.
Figure 3:
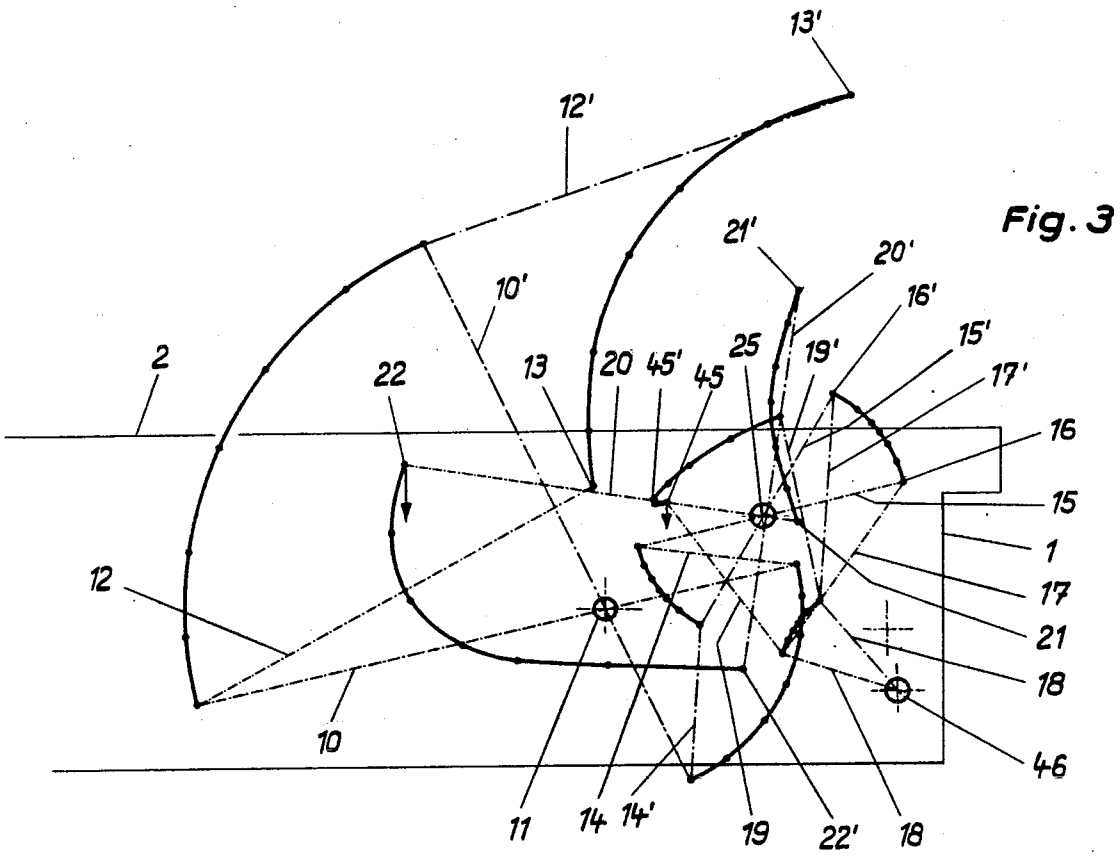
FIG. 3 is a diagram illustrating displacement of the levers and connecting rods of FIGS. 1 and 2 during operation.

When the ladder E is unlocked, the end 22 of the lever 20 pivotally connected to the first intermediate piece 32 of the ladder is urged downwards (FIG. 3) and describes the trajectory 22–22' while the other end 21 of lever 20 moves along the trajectory 21–21' which corresponds to a lifting up of the cover 2. This movement of lever 20 produces a displacement of the connecting rod 19 which is attached to it and which, because of its coupling with the levers 17 and 18, executes, at its junction 45 with the lever 20, a particular trajectory having a beak 45', which corresponds to a slight forward displacement of the cover 2, just sufficient to move it away from the rear edge of the casing 1 (FIG. 5). The other end of the connecting rod 19 follows the trajectory of the lever 18 pivoting about its point of attachment 46 to the casing 1. Simultaneously, the levers 15, 17 pass to 15', 17' thus bringing the point of attachment 16 of the cover 2 to 16' which corresponds to a lifting of the cover coupled with a forward displacement.

During its rotation about the axis 25 from the position 15 to position 15', the lever 15 which is also connected to rod 14 drives the latter to make the lever 10 pivot about its axis 11 from position 10 to position 10'. The lever 12 is driven by the lever 10 from position 12 to position 12' corresponding to complete opening of the cover 2.

The described system of levers and connecting rods is calculated with precision to allow the ladder to unfold by gravity while automatically opening the trap-door cover 2. The speed of unfolding of the ladder can be adjusted by tightening by a greater or lesser amount the joints of the uprights of the ladder or by modifying the weight 43.

The above-described operation is satisfactory if the ratios of the lengths of the levers and the connecting rods have well determined values.

A trap door as described is advantageously installed on each of several superimposed balconies of a multistorey building and serves as a lift-saving means in the event of fire. The tool enabling unlocking of the ladder is for example placed in a box closed by a window that must be broken to remove the tool. By unlocking the locking device 35 as described above, the ladder unfolds and by automatically opening the cover 2 enables the occupants of one storey to go down to the next storey where the same operation is carried out with the trap door installed on the balcony of that storey, and so on.

In some instances, notably for life-saving by firemen and the evacuation of injured persons, the trap door may be opened from the lower storey. For this purpose, use is made of the tool of the lower trap door which will be shown in FIG. 7, this tool having a handle 47 and a stem 47' which is sufficiently long to reach the lower cover (not shown) of the trap door situated above. A simple traction exerted on a ring fixed to this hinged lower cover enables opening of the latter to allow access to the casing 1 containing the ladder. when the trap door is normally opened from above, it is the ladder which, as it unfolds, opens the lower cover by a simple push.

The end of the tool has a female square 48 adapted to engage the square of rod 36, and a stirrup 49 adapted to engage the arm 39 of the rod 36 from below. By turning the arm 39 by the tool, the ladder is freed and, as described above, produces opening of the trap door cover. The tool has a retaining cross-piece 50 intended to receive the first rung 31 of the ladder so that the ladder does not a rapidly unfold onto a person actuating opening from below. This cross-piece 50 is inclined by 33° to the arms of stirrup 49.

The described trap-door and folding ladder arrangement may also be used to enable access to an attic or other premises, with the advantage of being of very small bulk. In this instance, the locking device would be manoeuvrable from below, both for unlocking and locking the ladder.

What we claim is:

1. A trap door and folding ladder arrangement comprising a casing able to receive the ladder folded in a storage position, the ladder comprising two uprights composed of rung-supporting pieces and intermediate pieces pivotally connected to one another to form an extensible folding structure, and a cover connected to the casing and to each upright of the ladder by a system of levers and connecting rods whereby the ladder when unfolding automatically actuates raising of the cover then moving it forward by a slight distance to free a rear edge of the cover from a corresponding side of the casing, and finally complete opening of the cover when the ladder is completely unfolded.

2. A trap door and ladder arrangement according to claim 1, in which the lever and connecting rod system comprises a first lever (10) pivotally connected to the casing and to a second lever (12) pivotally connected to the cover (2), and a last lever (20) pivotally connected to the cover and to an intermediate piece (32) towards an end of the corresponding upright of the ladder, the rung-supporting piece (30) of said end of the upright being pivotally connected to a fixed point (34) on the casing, and further comprising a locking device for retaining the ladder folded inside the casing.

3. A trap-door and ladder arrangement according to claim 2, in which said first lever (10) is pivotally mounted about a fixed point (11) on the casing and pivotally connected at one end to one end of said second lever (12) whose other end pivots about a fixed point (13) of the cover, the other end of said first lever (10) being pivotally connected to one end of a first connecting rod (14) whose other end is pivotally connected to one end of a third lever (15) pivoting about an axis (25) fixed on the cover and pivotally connected at its other end about an axis (16) fixed on the cover, said axis (16) also serving as pivoting axis for one end of a fourth lever (17) whose other end is pivotally connected to a fifth lever (18) and to a second connecting rod (19) pivotally connected to said last lever (20) of which one end (21) is pivotally connected to the cover and the other end (22) to said intermediate piece (32) towards said end of the corresponding upright of the ladder.

* * * * *